US006701632B2

(12) United States Patent
Henry

(10) Patent No.: US 6,701,632 B2
(45) Date of Patent: Mar. 9, 2004

(54) HTM DIRECT DRIVE AND POSITIVE POSITIONING CROSS SLIDE AND PIN HOUSING SYSTEM

(76) Inventor: Donald J Henry, P.O. Box 28, New Albany, PA (US) 18833

( * ) Notice: Subject to any disclaimer, the term of this patent is extended or adjusted under 35 U.S.C. 154(b) by 378 days.

(21) Appl. No.: 09/760,904

(22) Filed: Jan. 17, 2001

(65) Prior Publication Data

US 2003/0110647 A1 Jun. 19, 2003

(51) Int. Cl.[7] ..... F41G 1/467
(52) U.S. Cl. ..... 33/265; 124/87
(58) Field of Search ..... 33/265; 124/87, 124/88

(56) References Cited

U.S. PATENT DOCUMENTS 4,567,668 A * 2/1986 King et al. ..... 33/265
5,509,402 A * 4/1996 Sappington ..... 124/87
5,630,279 A * 5/1997 Slates ..... 33/265
5,644,849 A * 7/1997 Slates ..... 33/265
5,850,700 A * 12/1998 Capson et al. ..... 33/265
6,430,822 B1 * 8/2002 Slates ..... 33/265
6,453,898 B1 * 9/2002 Ahmann et al. ..... 124/87
6,477,778 B1 * 11/2002 Lorocco ..... 33/265
6,477,779 B1 * 11/2002 Slates ..... 33/265
6,508,005 B2 * 1/2003 Springer ..... 33/265

* cited by examiner

*Primary Examiner*—G. Bradley Bennett
(74) *Attorney, Agent, or Firm*—John J. Elnitski, Jr.

(57) ABSTRACT

A hunting, target or three dimensional single pin sight system, including a vertical and horizontal screw adjustment apparatus. The single sight pin housing system attaches to the end of the windage cross slide rod system. Both systems are designed to be located, parallel and perpendicular to the horizontal sight drive system. The windage cross slide rod system is positioned with a direct drive locating system.

6 Claims, 4 Drawing Sheets

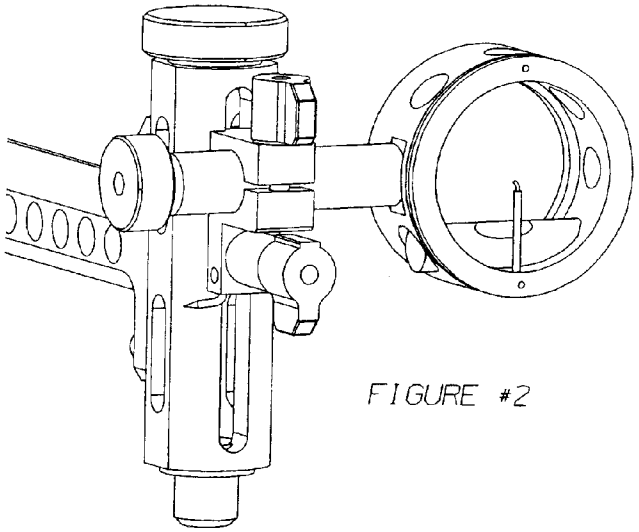
FIGURE #2
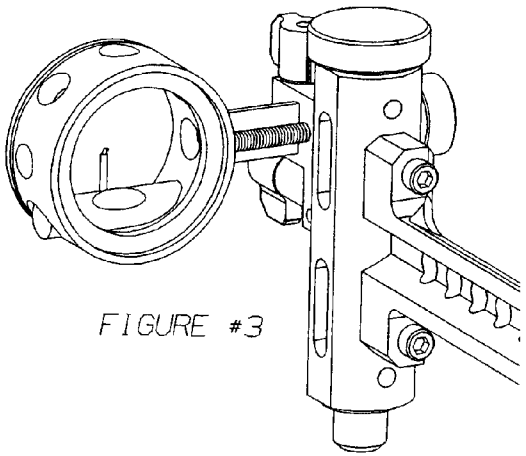
FIGURE #3
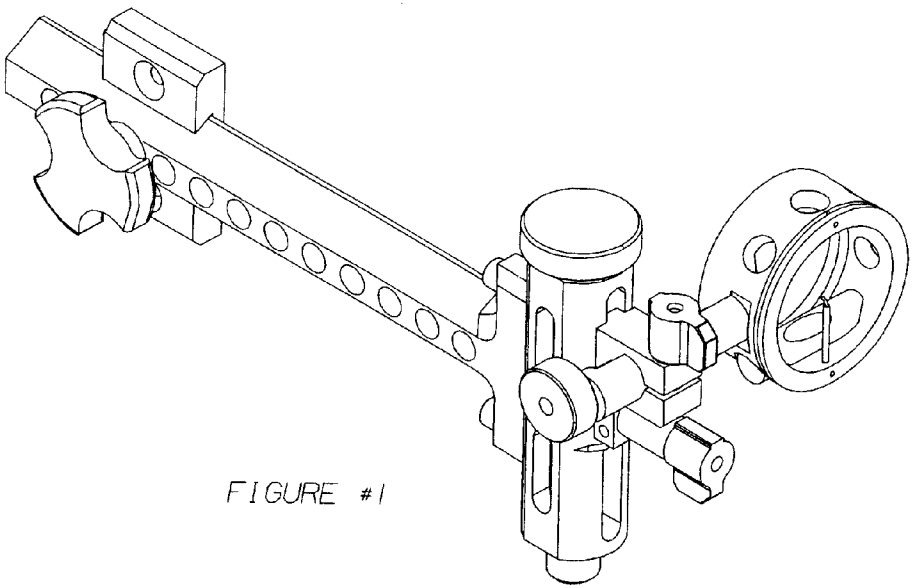
FIGURE #1

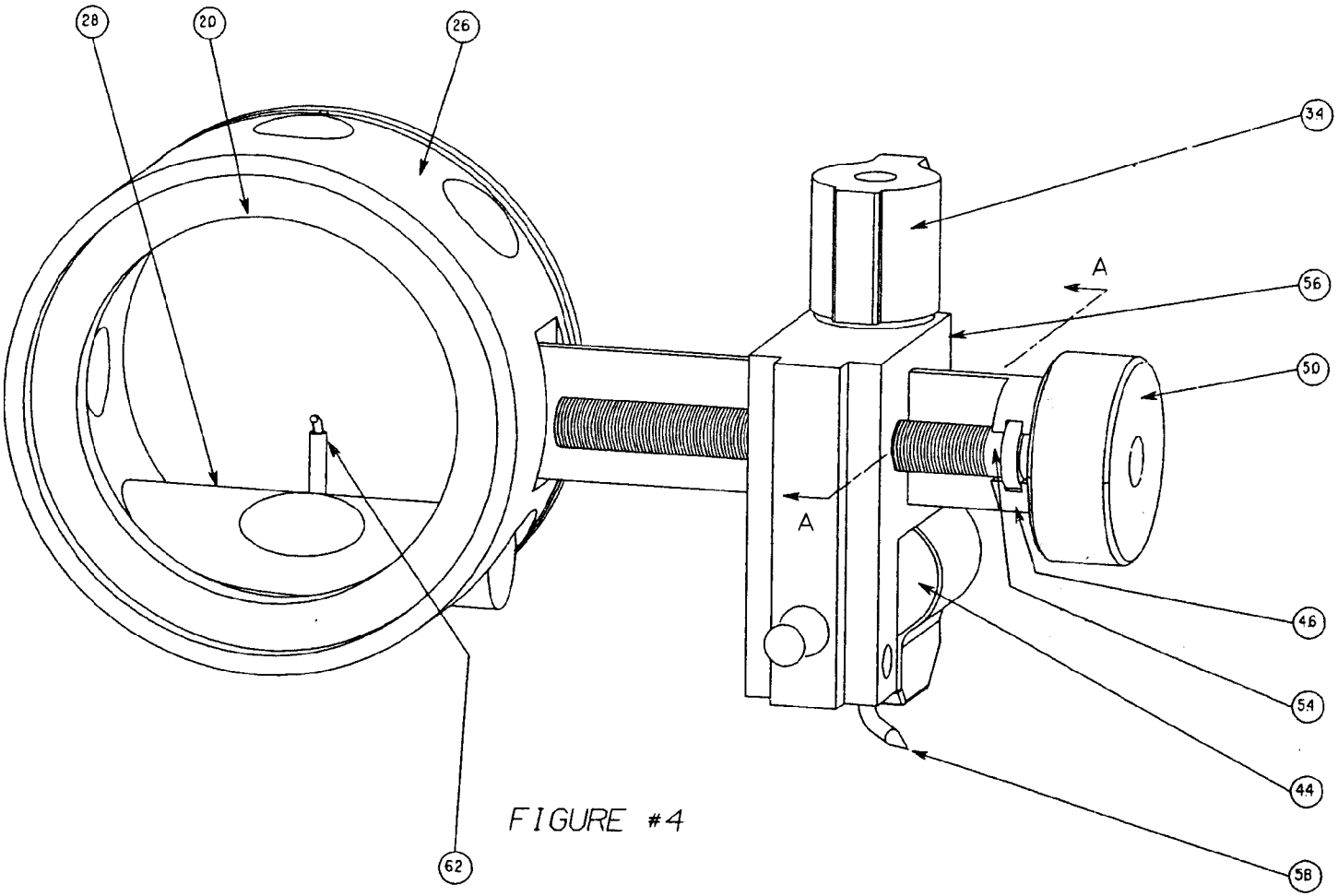
FIGURE #4

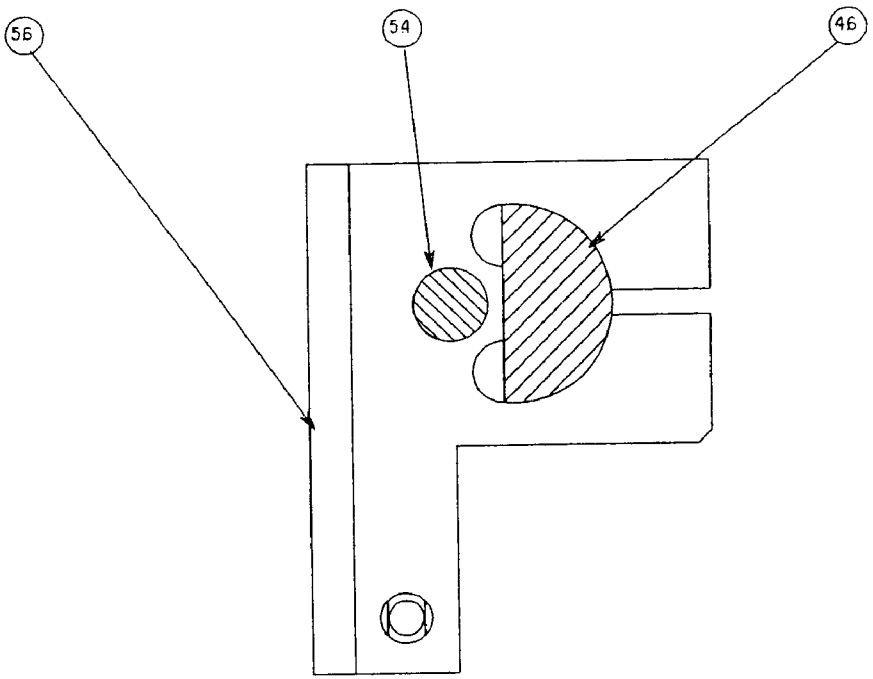
FIGURE #5
SECTION AA

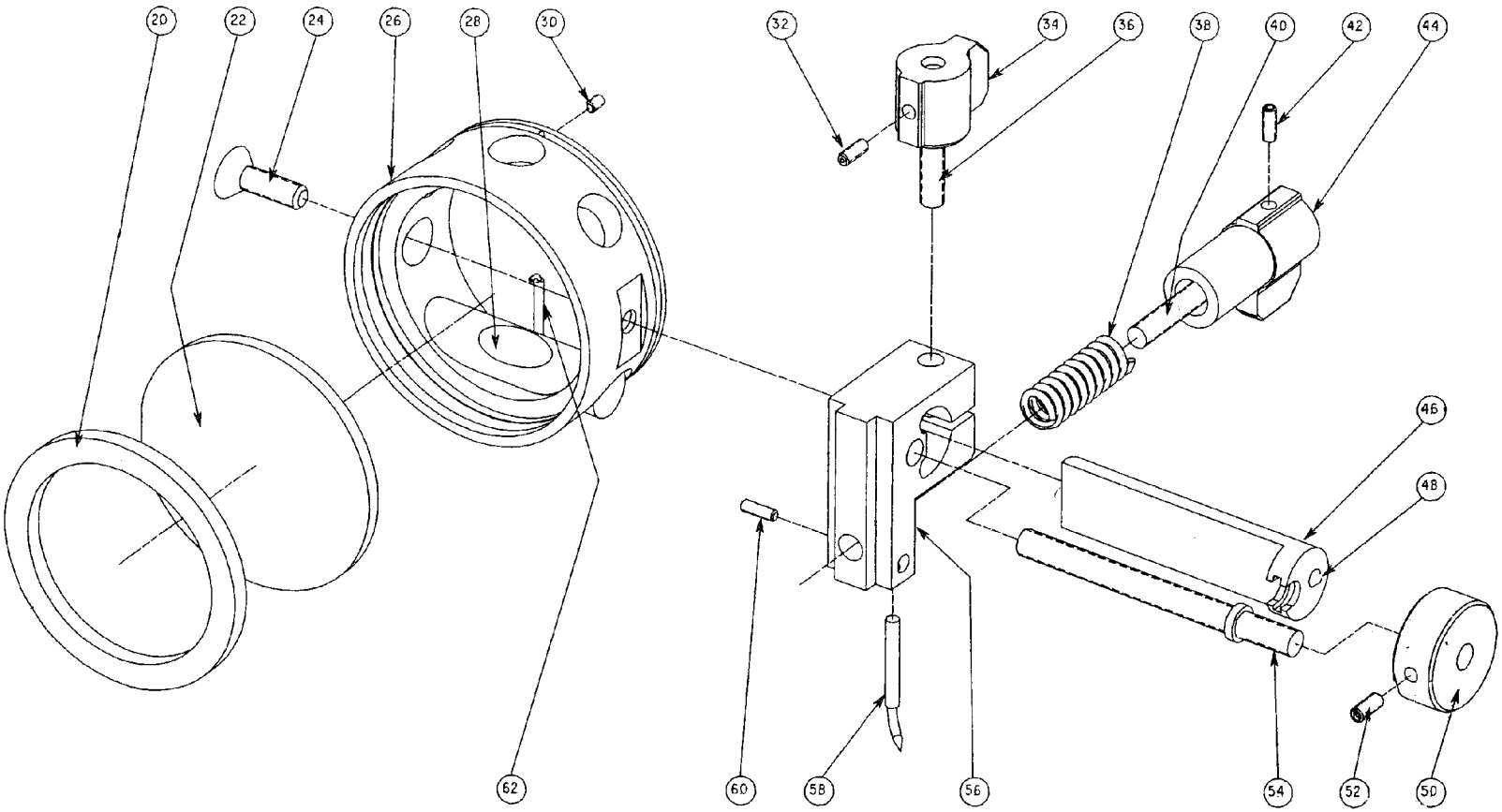
FIGURE #6

HTM DIRECT DRIVE AND POSITIVE POSITIONING CROSS SLIDE AND PIN HOUSING SYSTEM

BACKGROUND

1. Field of Invention

This invention relates to an archery bow sight, specifically to an improved positive positioning windage system.

2. Discussion of Prior Art

The Archer using a horizontal and vertical adjusting system, with attached lens holder, has round rod windage systems. This system makes it difficult to accurately locate 90° to the horizontal drive system. In addition, the pin sight housing attaches to the cross slide system with a threaded rod which, after continuous use, can break due to vibration.

OBJECTS AND ADVANTAGES

Accordingly, several objects and advantages of the present invention are:

a) a cross slide system that can only position parallel and perpendicular to the vertical drive sight system;

b) a direct drive system that eliminates any unwanted windage movement;

c) a clamping windage system that securely locates and locks all systems into desired position;

d) a sight lens and pin housing system that attaches to the cross slide system and is automatically located parallel to the vertical drive systems thus eliminating all adjustment error;

e) a sight lens and pin housing system that has a machined flat slot. The bottom and sides of the slot attaches to the flat end of the cross slide system and is securely locked into position by a flat head screw; and f) a sight lens and pin housing system that holds a sight lens which is clamped into position by a rubber "O" ring.

DRAWING FIGURES

FIG. 1 shows a three-dimensional front and side view of the bow sight.

FIG. 2 shows a front view of the bow sight.

FIG. 3 shows a rear view of the bow sight.

FIG. 4 shows a rear view of the sight pin housing and windage system.

FIG. 5 shows a side view of the windage holding bracket.

FIG. 6 shows an assembly and parts view of the bow sight.

REFERENCE NUMERALS IN DRAWINGS

20 Rubber Lens Retainer
22 Sight Lens
24 Lens Holder Retaining Screw
26 Sight Lens & Pin Housing
28 Level
30 4-40×⅛" Set Screw (2)
32 6-32×3/16" Set Screw
34 Windage Locking Knob
36 8-32×1" Set Screw
38 Retention Spring
40 10-32×1-½" Threaded Rod
42 6-32×3/16" Set Screw

44 Vertical Adjustment Locking Knob
46 Windage Cross Slide Rod
48 8-32×3/16" Ball Plunger
50 Windage Adjustment Knob
52 6-32×3/16" Set Screw
54 10-32×2-½" Windage Adjustment Screw
56 Windage Holding Bracket
58 Yardage Indicator Marker
60 4-40×3/16" Stainless Steel Nylon Tipped Set Screw
62 TruGlo® Sight Pin

SUMMARY

In accordance with the present invention a cross slide windage system with direct drive and a pin sight housing system are attached in which both systems are automatically located 90° to the vertical drive system.

DESCRIPTION—FIGS. 1 to 6

The windage adjustment knob 50 (FIG. 6) attaches to the 10-32×2-½" windage adjustment screw 54 (FIG. 6) and is locked into position by a 6-32×3/16" set screw 52 (FIG. 6). This assembly is positioned and retained into the windage cross slide rod 46 (FIG. 6). The windage cross slide rod 46 and windage adjustment screw 54 (FIG. 6) passes through the windage holding bracket 56 (FIG. 6). Attached to the end of the windage cross slide rod 46 (FIG. 6) is the sight lens and pin housing 26 (FIG. 6). This lens housing is attached with a lens holder retaining screw 24 (FIG. 6). The sight lens 22 (FIG. 6) fits into the sight lens and pin housing 26 (FIG. 6) and is secured into position by the rubber lens retainer 20 (FIG. 6). The windage locking knob 34 (FIG. 6) locks the windage cross slide rod 46 (FIG. 6) into position. The retention spring 38 (FIG. 6), the 10-32×1-½" threaded rod 40 (FIG. 6) and vertical adjustment locking knob 44 (FIG. 6) attach the windage holding bracket 56 (FIG. 6) to the vertical sight housing assembly bracket shown in FIG. 1, FIG. 2 and FIG. 3.

Screwed on to the end of the windage adjustment screw 54 (FIG. 6) is the windage adjustment knob 50 (FIG. 6). The windage adjustment knob 50 (FIG. 6) has twelve "V" groove slots on it's surface. A 6-32×3/16" set screw 52 (FIG. 6) locates the windage adjustment knob 50 (FIG. 6) and holds it into position. An 8-32×3/16" ball plunger 48 (FIG. 6) is located into the windage cross slide rod end 46 (FIG. 6). The machined ridge on the windage adjustment screw 54 (FIG. 6) is positioned into the groove located on the windage cross slide rod 46 (FIG. 6) and the windage adjustment screw 54 (FIG. 6) pass through the windage holding bracket 56 (FIG. 6). A yardage indicator marker 58 (FIG. 6) slides up into the windage holding bracket 56 (FIG. 6) and is locked into position by a 4-40×3/16" stainless steel nylon tipped set screw 60 (FIG. 6). An 8-32×1" set screw 36 (FIG. 6) screws into the windage locking knob 34 (FIG. 6). The assembly of set screw 32, knob 34 and set screw 36 (FIG. 6) screw into the windage holding bracket 56 (FIG. 6) and lock the windage cross slide rod 46 (FIG. 6) into position. Attached to the end of rod 46 (FIG. 6) is the sight lens and pin housing 26 (FIG. 6) by a lens holder retaining screw 24 (FIG. 6). Level 28 (FIG. 6) is epoxy glued into position into the sight lens and pin housing 26 (FIG. 6). The TruGlo® sight pin 62 (FIG. 6) passes through a hole located in the sight housing 26 (FIG. 6) and wraps around a groove on the outer edge and continues through an additional hole and is secured into position by a 4-40×⅛" set screw 30 (FIG. 6). Sight lens 22 (FIG. 6) fits into the housing 26 (FIG. 6). Rubber lens retainer 20 (FIG. 6) presses into a groove in the housing 26 (FIG. 6) and retains sight lens into the housing 26 (FIG. 6).

A 10-32×1-½" threaded rod 40 (FIG. 6) screws into the vertical adjustment locking knob 44 (FIG. 6) and is secured into position by a 6-32×3/16" set screw (FIG. 6). Spring 38 (FIG. 6) slides onto rod 40 (FIG. 6) and recesses into knob 44 (FIG. 6). The vertical locking knob assembly 38, 40, 42 and 44 (FIG. 6) pass through bracket assembly 56, 58 and 60 (FIG. 6) and hold the windage assembly which include 46, 48, 50, 52 and 54 (FIG. 6) and the sight housing assembly 20, 22, 24, 26, 28, 30 and 62 (FIG. 6) and the windage locking knob assembly 32, 34 and 36 (FIG. 6) and are attached to the vertical sight housing assembly bracket shown in FIGS. 1, 2 and 3. In addition, a machined flange on bracket 56 (FIG. 6) locates the complete cross slide assembly parallel and perpendicular to the vertical sight housing assembly (FIGS. 1, 2 & 3).

OPERATION—FIGS. 1 to 6

The windage holding bracket 56 (FIG. 4) with a machined flange is manufactured out of anodized aluminum, stainless steel or titanium, holds the cross slide windage system to the vertical sight housing assembly bracket shown in FIGS. 1, 2 and 3. The stainless steel yardage indicator marker 58 (FIG. 6) slides in and out of the windage holding bracket 56 (FIG. 6) which provides ample amount of adjustment if marker 58 (FIG. 6) has to be moved. A 4-40×3/16" stainless steel nylon tipped set screw 60 (FIG. 6) locks marker into place.

A stainless steel 10-32×1-½" threaded rod 40 (FIG. 6) screws into the vertical adjustment locking knob 44 (FIG. 6) and is secured with a stainless steel 6-32×3/16" set screw 42 (FIG. 6). This assembly slides through a one inch long stainless steel retention spring 38 (FIG. 6) and recess into locking knob 44 (FIG. 6). The assembly continues and passes through the windage holding bracket 56 (FIG. 6) and locks the windage system to the vertical sight housing assembly bracket shown in FIGS. 1, 2 and 3.

The short threaded end of the brass double ended 10-32×2-½' windage adjustment screw 54 (FIG. 6) screws into an anodized aluminum windage adjustment knob 50 (FIG. 6) and is locked into position with a 6-32×3/16" set screw 52 (FIG. 6). This creates the windage screw assembly 50, 52 and 54 (FIG. 6). Knob 50 (FIG. 6) has a knurled diameter, and the face of the knob 50 (FIG. 6) has "V" grooves. When assembled into the windage cross slide rod 46 (FIG. 6) the grooves on knob 50 (FIG. 6) create a clicking sound that indicates the amount of desired windage movement. The anodized aluminum or titanium rod 46 (FIG. 6) has an 8-32×3/16" ball plunger 48 (FIG. 6) recessed into one end. The ball plunger 48 (FIG. 6) protrudes outward to create the clicking sound when rotating against the "V" grooves located on the face of knob 50 (FIG. 6). Rod 46 (FIG. 6) is machined beyond the center point of the diameter and approximately 90% of its length. The purpose of the machined surface located on rod 46 (FIG. 6) is to guarantee 90° positioning. A slotted groove is machined into the side of rod 46 (FIG. 6) located near the ball plunger 48 (FIG. 6). The protruding ring located on the screw 54 (FIG. 6) and assembled parts screw 52 and screw 54 (FIG. 6) slide into the groove located on rod 46 (FIG. 6). The screw 54 (FIG. 6) is then securely positioned within rod 46 (FIGS. 4 and 6).

Windage holding bracket 56 (FIG. 5) has a through 10-32 threaded hole. This threaded hole holds the 10-32×2-½" windage adjustment screw 54 (FIGS. 5 and 6). A machined slot located on the bracket 56 (FIGS. 5 and 6) which rod 46 (FIGS. 5 and 6) passes through. The slot located on bracket 56 (FIGS. 5 and 6) is machined with a half moon radius and perpendicular surface (FIG. 5). When the windage screw assembly 50, 52 and 54 screws into bracket 56 (FIG. 6) it pulls the rod 46 (FIG. 6) through or back out depending on the direction of knob 50, creating a positive positioning system.

An 8×32×1" set screw 36 (FIG. 6) screws into the windage locking knob 34 (FIG. 6) and is locked into position by a 6-32×3/16" set screw 32 (FIG. 6). This assembly then screws into bracket 56 (FIG. 6) and locks rod 46 (FIG. 6) into position.

An anodized aluminum sight lens and pin housing 26 (FIG. 6) has a level 28 (FIG. 6) and a TruGlo® sight pin 62 (FIG. 6). The sight pin passes through the housing into place, and is parallel to the machined slot. The sight is held into position by two 4-40×⅛" set screws 30 (FIG. 6). Housing 26 encases sight lens 22 (FIG. 6) and the lens 22 (FIG. 6) is retained by a rubber lens retainer 20 (FIG. 6). The rubber lens retainer 20 (FIG. 6) presses into a machined groove located on the inside rim of housing 26 (FIG. 6). Housing 26 (FIG. 6) has a machined slot 90° to the level and parallel to the sight pin. The slot in the housing is attached to the end of rod 46 (FIG. 6) and is secured and retained by the lens holder retaining screw 24 (FIG. 6). The vertical slot in housing 26 and vertical surface on rod 46 create positive perpendicular and vertical positioning for the sight pin and housing of the bow sight.

CONCLUSION, RAMIFICATIONS, AND SCOPE

Accordingly, the HTM Direct Drive and Positive Positioning Cross Slide and Pin Housing System provides a direct drive system that eliminates any unwanted windage movement. Furthermore, the system as the additional advantages in that:

- The system can only position parallel and perpendicular to the vertical drive sight system;
- The clamping windage system securely locates and locks all systems into desired position;
- The sight lens and pin housing system attaches to the cross slide system and is automatically located parallel and perpendicular to the vertical drive systems, thus eliminating all adjustment error;
- The sight lens and pin housing system has a machined flat slot. The bottom and sides of the slot attaches to the flat end of the cross slide system and is securely locked into position by a flat head screw; and
- The sight lens and pin housing system holds a sight lens which is clamped into position by a rubber "O" ring.

Although the description above contains many specifics, those should not be construed as limiting the scope of the invention but as merely providing illustrations of some of the presently preferred embodiments of this invention.

Thus the scope of the invention should be determined by the appended claims and their legal equivalents, rather than by the examples given.

What I claim as my invention is:

1. A horizontal windage slide rod system comprising:

a windage adjustment screw having a first end and a second end, and said windage adjustment screw being threaded between said first end and said second end of said windage adjustment screw a windage adjustment knob attached to said first end of said windage adjustment screw for rotating said windage adjustment screw;

a windage slide rod, said windage slide rod having a first end, second end and a machined surface between said first and second end, said windage slide rod having a slide rod groove to receive and position said windage adjustment screw, said second end of said windage slide rod adapted to securely mount an archery sight, and said machined surface providing a total shape of said windage slide rod other than a circle to provide a surface for locking said windage slide rod in position and prevent rotation of said windage slide rod;

a windage holding bracket for mounting to an assembly bracket extending from an archery bow, said windage holding bracket having a machined slot, threaded windage adjustment screw hole, locking slot windage locking set screw, windage locking set screw hole and threaded windage locking set screw hole, said machined slot having a shape that is the same as said windage slide rod at said machined surface to allow insertion of said second end of said windage slide rod and allow said windage slide rod to pass along said machined slot, said threaded windage adjustment screw hole aligned to receive said windage adjustment screw, said locking slot passing through said windage holding bracket and into said machined slot, said windage locking set screw hole positioned over one side of said locking slot to allow passage of said windage locking set screw through said windage holding bracket and pass through said locking slot, said threaded windage locking set screw hole aligned on an other side of said locking slot to receive said windage locking set screw from said windage locking set screw hole to allow tightening of said windage holding bracket about said windage slide rod.

2. The horizontal windage slide rod system of claim 1, wherein said windage adjustment screw includes a protruding ring located about a diameter of said windage adjustment screw and near said first end of said windage adjustment screw; wherein said windage slide rod includes a slide rod slot in said slide rod groove to receive said protruding ring to retain said windage adjustment screw in position in relation to said windage slide rod.

3. The horizontal windage slide rod system of claim 1, further including a flange extending from said windage holding bracket to interlock with said assembly bracket to lock said windage holding bracket in position.

4. The horizontal windage slide rod system of claim 1, further including a windage adjustment knob attached to said first end of said windage adjustment screw for rotating said windage adjustment screw.

5. The horizontal windage slide rod system of claim 4, further including grooves in a face of said windage adjustment knob and a ball plunger extending out of said first end of said windage slide rod such that said ball plunder interacts with sad grooves of said windage adjustment knob to indicate rotation of said windage adjustment knob.

6. The horizontal windage slide rod system of claim 1, wherein said total shape is crescent shaped with an adjacent flat surface.

* * * * *